US010038954B2

(12) United States Patent
Voishvillo

(10) Patent No.: US 10,038,954 B2
(45) Date of Patent: Jul. 31, 2018

(54) COMPRESSION DRIVER AND PHASING PLUG ASSEMBLY THEREFOR

(71) Applicant: Harman International Industries, Inc., Stamford, CT (US)

(72) Inventor: Alexander Voishvillo, Simi Valley, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 30 days.

(21) Appl. No.: 15/243,221

(22) Filed: Aug. 22, 2016

(65) Prior Publication Data

US 2018/0054671 A1 Feb. 22, 2018

(51) Int. Cl.
*H04R 1/30* (2006.01)
*H04R 9/06* (2006.01)

(52) U.S. Cl.
CPC ..... *H04R 1/30* (2013.01); *H04R 9/066* (2013.01); *H04R 2201/34* (2013.01)

(58) Field of Classification Search
CPC ..... H04R 1/30
See application file for complete search history.

(56) References Cited

U.S. PATENT DOCUMENTS 4,325,456 A 4/1982 Ureda
5,537,481 A 7/1996 Voishvillo et al.
5,878,148 A 3/1999 Alexandrov
6,320,970 B1 11/2001 Czerwinski et al.
7,039,211 B2 5/2006 Werner
8,036,408 B2 10/2011 Voishvillo
8,077,897 B2 12/2011 Voishvillo
8,280,091 B2 10/2012 Voishvillo
(Continued)

FOREIGN PATENT DOCUMENTS

DE 102015209837 A1 12/2015
EP 2640089 A2 9/2013

OTHER PUBLICATIONS

U.S. Office Action for U.S. Appl. No. 14/878,803, dated May 1, 2017, 24 pages.

(Continued)

*Primary Examiner* — Duc Nguyen
*Assistant Examiner* — Phan Le
(74) *Attorney, Agent, or Firm* — Brooks Kushman P.C.

(57) ABSTRACT

A compression driver includes a phasing plug having a base portion with a first side and an opposed second side, and includes a hub portion extending outwardly from the first side along a central axis, the hub portion including an outer surface. The base portion includes a plurality of apertures that extend therethrough from the first side to the second side, the apertures arranged generally circumferentially about the central axis and oriented generally parallel to the outer surface of the hub portion. A diaphragm is disposed adjacent the phasing plug second side, and a compression chamber is defined between the diaphragm and the phasing plug. A housing is positioned on the phasing plug first side, the housing having a central aperture generally aligned with the hub portion and forming an exit of the compression driver, the housing having an inner surface which forms a waveguide with the outer surface of the hub portion.

18 Claims, 11 Drawing Sheets

(56) References Cited

U.S. PATENT DOCUMENTS

| | | | | |
|---|---|---|---|---|
| 2004/0156519 | A1* | 8/2004 | Geddes | H04R 1/34 381/343 |
| 2007/0147647 | A1* | 6/2007 | Voishvillo | H04R 1/30 381/343 |
| 2009/0310809 | A1 | 12/2009 | Voishvillo | |
| 2011/0085692 | A1 | 4/2011 | Voishvillo | |
| 2011/0168480 | A1* | 7/2011 | Sterling | H04R 1/345 181/176 |
| 2016/0105744 | A1 | 4/2016 | Voishvillo | |

OTHER PUBLICATIONS

International Search Report and Written Opinion for Application No. PCT/US2017/042715, dated Sep. 11, 2017, 13 pages.

* cited by examiner

COMPRESSION DRIVER AND PHASING PLUG ASSEMBLY THEREFOR

TECHNICAL FIELD

Embodiments relate to a compression driver and phasing plug assembly therefor.

BACKGROUND

There are two major types of compression drivers, the first utilizing a dome diaphragm, and the other using an annular flexural diaphragm. The majority of modern annular diaphragms are made of polymer films. The advantage of annular diaphragms is the smaller radial dimensions of the moving part of the diaphragm compared to the dome diaphragms having the same diameter of the moving voice coil. The small radial clamping dimension of the annular diaphragm shifts the mechanical breakup resonances of the diaphragm to higher frequencies where they can be better mechanically damped, since the damping is more efficient at high frequencies in polymer films. Better damping is indicative of the smoother frequency response and lower nonlinear distortion generated by diaphragms' breakups at high frequency.

In a compression driver, the diaphragm is loaded by a compression chamber, which is a thin layer of air separating the diaphragm from a phasing plug. The small radial dimension of the annular diaphragm corresponds to the small radial dimensions of the matching compression chamber, which shifts undesirable air resonances (cross-modes) in the chamber to higher frequencies, sometimes above the audio range in small-format compression drivers. Since the annular diaphragm has two clamping perimeters, inside and outside of the moving part of the diaphragm, the annular diaphragm has a better dynamic stability and it is less prone to the rocking modes compared to a dome diaphragm that has only external clamping.

The volume of air entrapped in the compression chamber is characterized by an acoustical compliance which is proportional to the volume of compression chamber. Acoustical compliance acts as a low-pass filter of the first order and it mitigates the high frequency signal. Therefore, it is desirable to keep the volume of the compression chamber (which depends on the distance between the diaphragm and the phasing plug) low. However, excessively close positioning of the diaphragm to the phasing plug generates distortion due to the nonlinear compression of air in the compression chamber, and may cause rub and buzz or even collision of the diaphragm with the phasing plug. As such, positioning of the diaphragm with respect to the phasing plug is always a compromise.

The area of the entrance to the phasing plug is significantly smaller than the area of the diaphragm. The air paths of the phasing plug are essentially the beginning of the horn which is attached to the compression driver to control directivity (i.e., coverage of sound pressure over a particular listening area) and to increase reproduced sound pressure level over a certain frequency range. The overall acoustical cross-sectional area of the air paths in the phasing plug (there are typically multiple paths) and then of the horn must gradually increase to provide a smooth transition of sound waves to the mouth of the horn. The narrowing of the area would produce undesirable reflections of sound waves back to the entrance of the horn which would interfere with the outgoing sound waves and would produce severe ripples on the sound pressure frequency response.

One of the problems of compression drivers is the radial standing waves (air resonances) that are generated in the compression chamber at high frequencies where the wavelength of the sound signal is smaller than the radial dimensions of the compression chamber. Using multiple concentric exits may mitigate these resonances that cause a combining effect and severe irregularity of the frequency response at high frequencies. Compression chamber air resonances may be generated in a compression driver when either a dome or annular diaphragm is used. In the latter case, due to typically smaller radial dimensions, the air resonances are generated at higher frequencies.

The traditional method used to suppress air resonances is forming circular slots in the phasing plug at certain diameters. However, circular slots do not improve the irregularity of the high-frequency sound pressure level response because of the influence of diaphragm breakups. Another method proposed to mitigate the negative effect produced by air resonances in the compression chamber is a non-circular pattern of slots, therefore providing averaging, randomization, and integration of sound pressure in compression chamber in such a way that the overall frequency response becomes smoother.

Compression drivers usually have standard circular exit diameters, typically 1" for small-format compression drivers, 1.5", and 2" for larger format compression drivers. Compression drivers which use an annular diaphragm have an adapter assembly that connects the driver to the horn, where the adapter assembly includes a phasing plug and an outer housing. The phasing plug may include a hub portion or central bullet having an outer surface, and the cylindrical, conical or curved outer housing includes an inner surface. The outer surface and inner surface cooperatively define a waveguide for the propagation of sound waves through the adapter assembly. The output end of the housing may be coupled to the input end of the horn or waveguide by any suitable means, such as via threaded surfaces, with the intention that the waveguide fluidly communicates with the interior of the horn.

Compression drivers may have radial slots in the phasing plug that direct the sound signal towards the center of the driver. In such configurations, the sound signal must make a 90 degree turn at the central bullet and then propagate towards the exit of the driver. The drawback of radial channels is that they work well only as long as their lengths are smaller than the wavelength of the sound signal. In large format drivers, the radial slots are directed toward the large central conical bullet, where the sound signals merge together and then are redirected towards the exit of the driver. At high frequencies, the signal may be reflected from the central bullet and radiated backwards.

SUMMARY

In one embodiment, a compression driver is provided includes a phasing plug having a base portion with a first side and an opposed second side, and includes a hub portion extending outwardly from the first side along a central axis, the hub portion including an outer surface. The base portion includes a plurality of apertures that extend therethrough from the first side to the second side, the apertures arranged generally circumferentially about the central axis and oriented generally parallel to the outer surface of the hub portion. A diaphragm is disposed adjacent the phasing plug second side, and a compression chamber is defined between the diaphragm and the phasing plug. A housing is positioned on the phasing plug first side, the housing having a central aperture generally aligned with the hub portion and forming an exit of the compression driver, the housing having an inner surface which forms a waveguide with the outer surface of the hub portion.

In another embodiment, a phasing plug assembly for a compression driver is provided including a phasing plug having a base portion with a first side and an opposed second side, and including a hub portion extending outwardly from the first side along a central axis, the hub portion including an outer surface. The base portion includes a plurality of apertures that extend therethrough from the first side to the second side, the apertures including a series of slots positioned end-to-end generally circumferentially about the central axis and oriented generally parallel to the outer surface of the hub portion. A housing is positioned on the phasing plug first side, the housing having a central aperture generally aligned with the hub portion and forming an exit of the compression driver, the housing having an inner surface which forms a waveguide with the outer surface of the hub portion.

In another embodiment, a phasing plug assembly for a compression driver is provided including a phasing plug having a base portion with a first side and an opposed second side, and including a hub portion extending outwardly from the first side along a central axis, the hub portion including an outer surface. The outer surface of the hub portion has a generally cylindrical cross-section at a first end proximate the base portion and transitions into a blade shape at a second end disposed at a distance from the base portion. The base portion includes a plurality of apertures that extend therethrough from the first side to the second side, the apertures arranged generally circumferentially about the central axis and oriented generally parallel to the outer surface of the hub portion. A housing is positioned on the phasing plug first side, the housing having a rectangular central aperture generally aligned with the hub portion and forming an exit of the compression driver, the housing having an inner surface which forms a waveguide with the outer surface of the hub portion.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
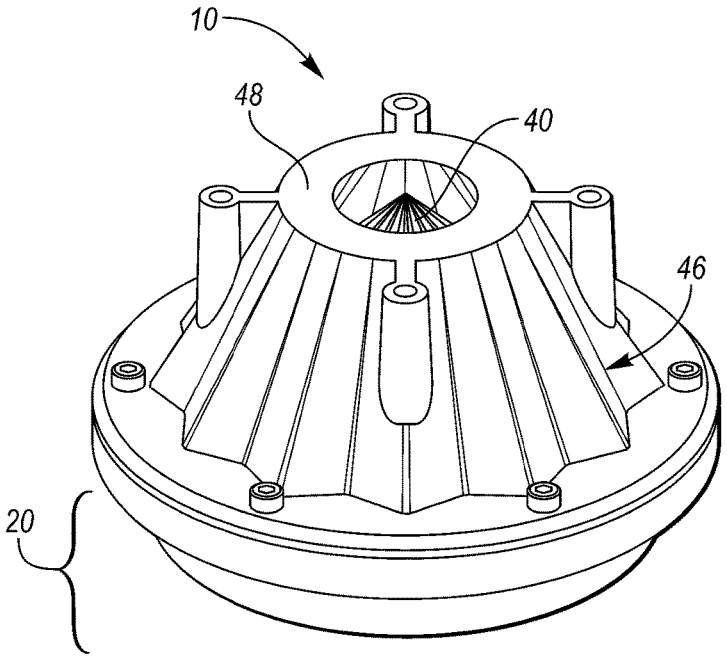
FIG. 1 is a perspective view of a compression driver according to an embodiment.
Figure 2:
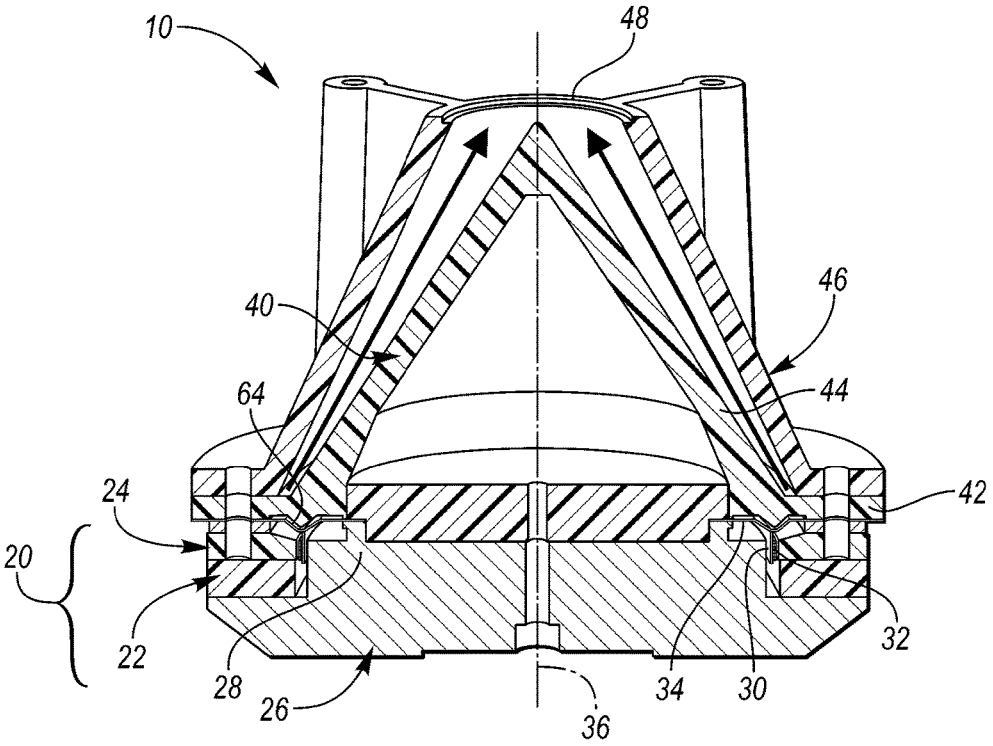
FIG. 2 is a cross-sectional view of the compression driver of FIG. 1, where the arrows indicate propagation of sound wave from the compression chamber to the exit of the driver.
Figure 16:
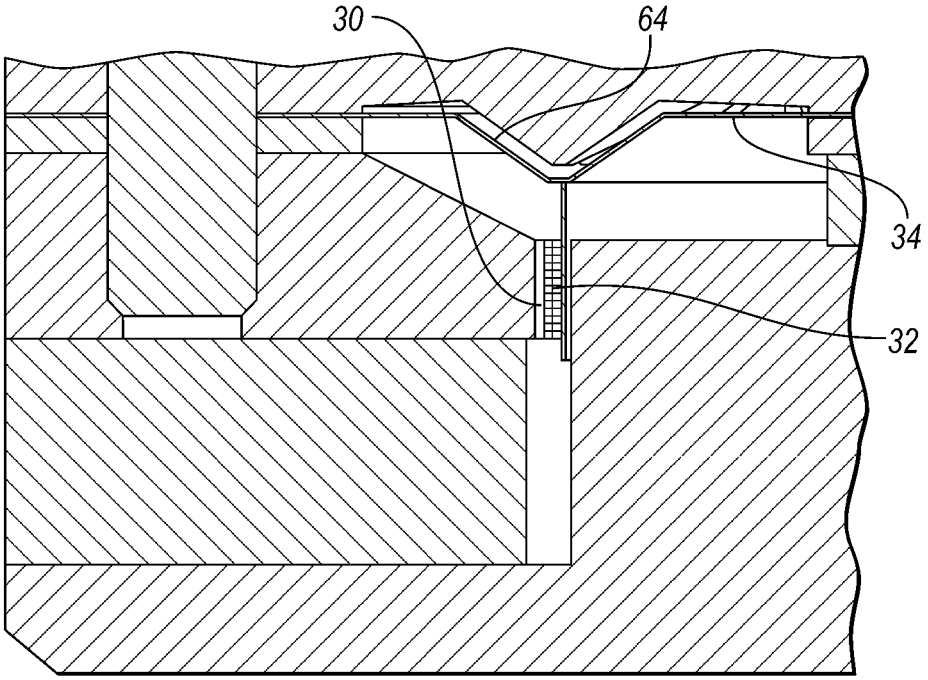
FIG. 16 is an enlarged view, cutaway view of the voice coil, diaphragm and compression chamber areas of the compression driver of FIGS. 1 and 2.

With reference first to FIGS. 1, 2 and 16, a compression driver 10 according to an embodiment may include a magnet assembly 20 which may comprise an annular permanent magnet 22 disposed between an annular top plate 24 and a back plate 26 that includes a centrally disposed cylindrical or annular pole piece 28. The magnet assembly 20 provides a permanent magnetic field in the gap 30 between the pole piece 28 and an inside surface of the annular top plate 24 for electrodynamic coupling with a voice coil 32. The voice coil 32 is disposed in the magnetic gap 30 and produces the movement of the flexible portion of a diaphragm 34. In one embodiment, the diaphragm 34 may be configured as an annular ring that is disposed coaxially with a central axis 36 above the magnet assembly 20. The diaphragm 34 may include a profiled section such as a V-shaped section. In other implementations, the diaphragm 36 may have other suitable configurations.

As shown in FIGS. 1, 2, 3A and 3B, the compression driver 10 also includes a phasing plug 40 having a base portion 42 and a central or hub portion 44 extending outwardly from the base portion 42, both of which are coaxially disposed about the central axis 36. The hub portion 44 may also be referred to as a bullet. The hub portion 44 may be integrally formed with the base portion 42 or may be attached to the base portion 42 by any suitable means. The base portion 42 of the phasing plug 40 may be generally circular or may have any other suitable geometry. The phasing plug 40 is disposed within a housing 46 positioned on or attached to the phasing plug 40, together forming a phasing plug assembly, wherein a central aperture 48 of the housing 46 serves as an exit of the compression driver 10. The central aperture 48 may be circular as shown, or alternatively may have another shape, such as elliptical or rectangular, as described further below with reference to FIGS. 11-14. As assembled, the central aperture 48 of the housing 46 is generally aligned with the hub portion 44.

Figure 3A:
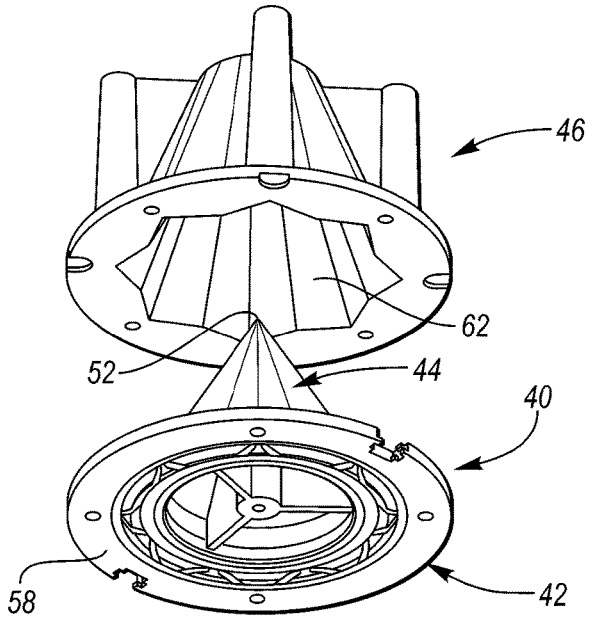
FIGS. 3A and 3B are perspective and front views, respectively, of the phasing plug and housing of FIG. 1, wherein a series of diagonal slots are utilized as apertures in the phasing plug.
Figure 3B:
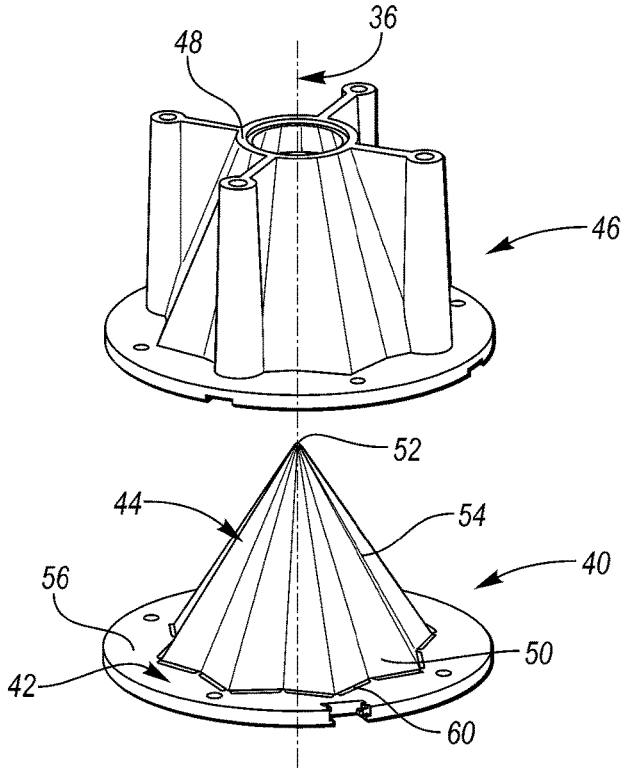

With reference to FIG. 3B, the hub portion 44 has a first end 50 disposed proximate to the base portion 42 and a second end 52 disposed at a distance from the base portion 42 along the central axis 36. An outer surface 54 of the hub portion 44 may taper in the direction along the central axis 36 from the first end 50 to the second end 52, such that the radius of the cross-section of the hub portion 44 relative to the central axis 36 decreases in this direction.

Figure 4:
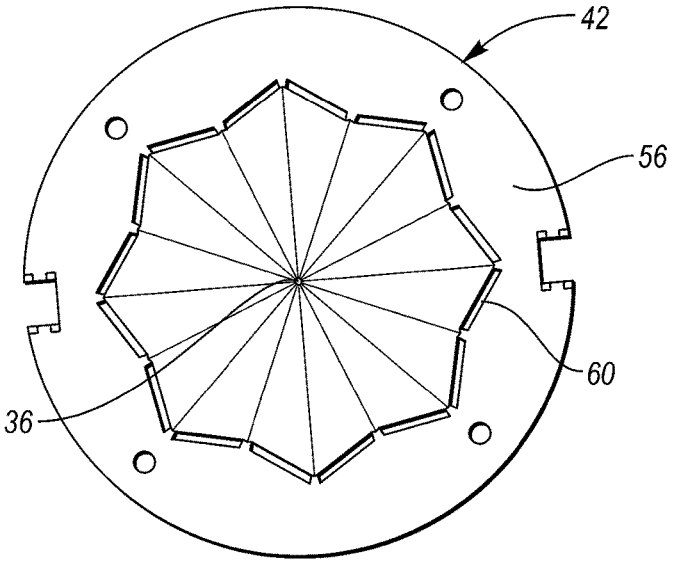
FIG. 4 is a bottom view of the phasing plug of FIGS. 3A and 3B as it faces the diaphragm.
Figure 5:
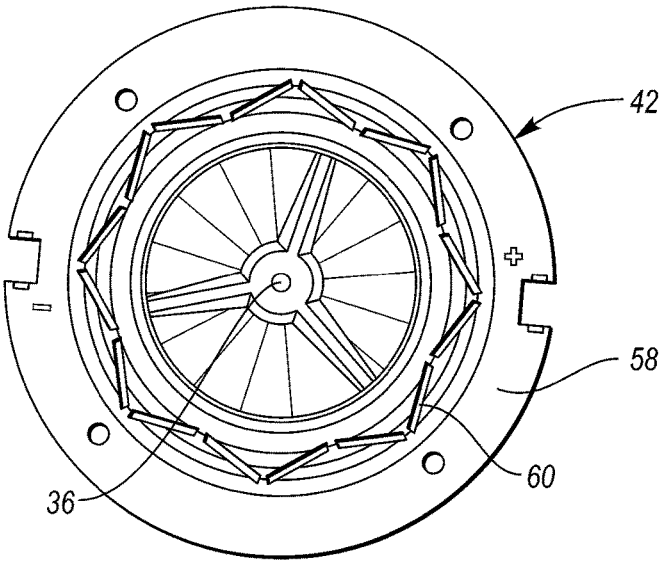
FIG. 5 is a top view of the phasing plug of FIGS. 3A and 3B as it faces the exit of the driver.
Figure 6A:
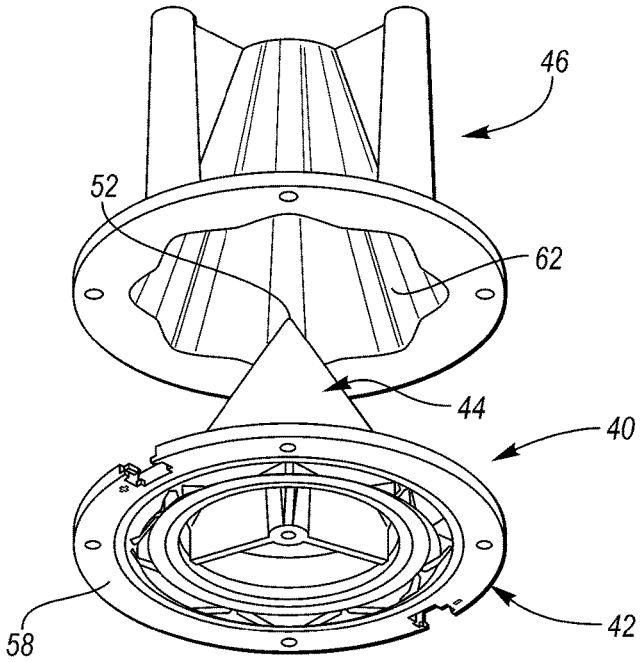
FIGS. 6A and 6B are perspective and front views, respectively, of another embodiment of phasing plug and housing, wherein a series of curved slots are utilized as apertures in the phasing plug.
Figure 6B:
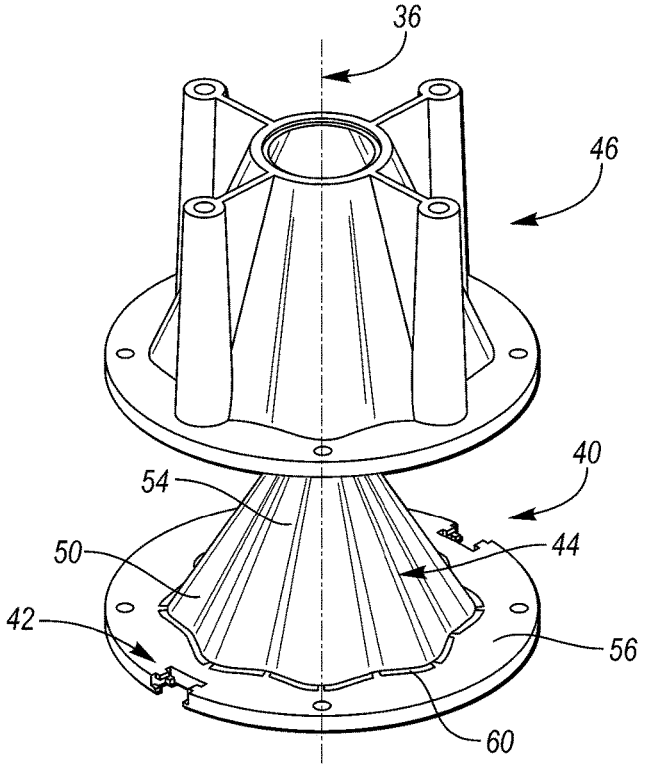
Figure 7:
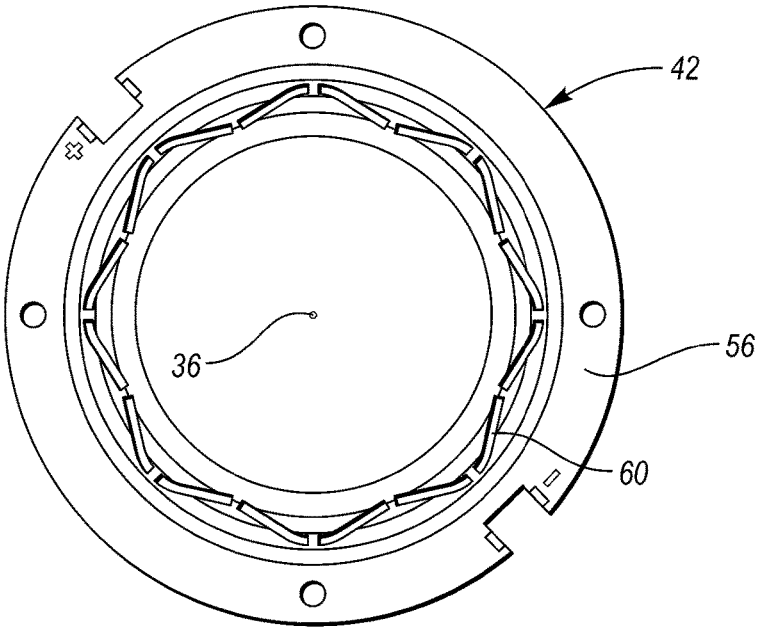
FIG. 7 is a bottom view of the phasing plug of FIGS. 6A and 6B as it faces the diaphragm.
Figure 8:
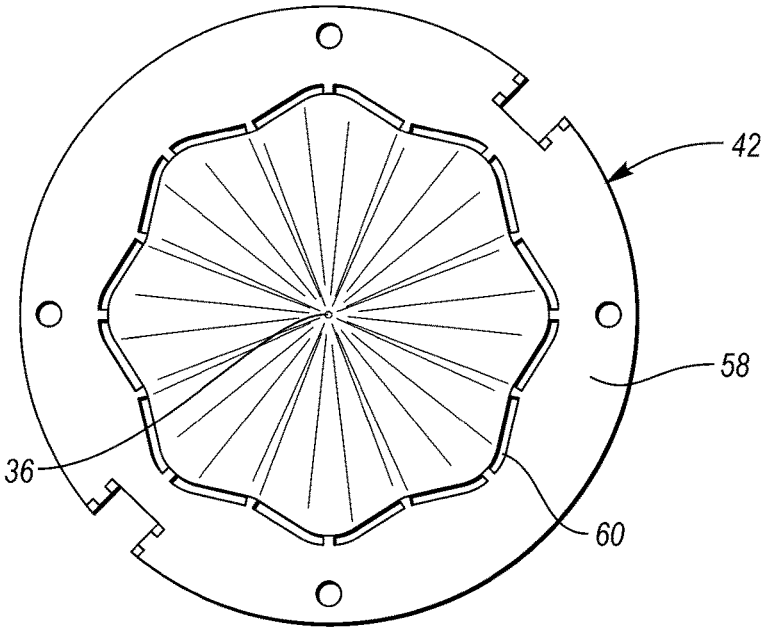
FIG. 8 is a top view of the phasing plug of FIGS. 6A and 6B as it faces the exit of the driver.

The base portion 42 of the phasing plug 40 includes a first side 56 (FIG. 4) generally facing the housing 46, and an opposing second side 58 (FIG. 5) generally facing the diaphragm 34. The base portion 42 further includes one or more apertures 60 that extend as passages through the base portion 42 from the first side 56 to the second side 58 through which sound waves created by the diaphragm 34 may travel. The outer surface 54 of the hub portion 44 may have a geometry or contour which corresponds to the configuration of the apertures 60, and the inner surface 62 of the housing 46 may have a geometry or contour which corresponds to the contour of the hub portion outer surface 54, as further described below. The sound waves propagate through the apertures 60 into the waveguide formed by the outer surface 54 of the hub portion 44 and the inner surface 62 of the housing 46, and then out through the central aperture 48 to exit the compression driver 10.

In the embodiments depicted herein, the apertures 60 may be arranged generally circumferentially about the central axis 36. In other words, the apertures 60 generally form a circle with respect to the center of the base portion 42, and are oriented generally parallel to the outer surface 54 of the hub portion 44, rather than generally perpendicular to the hub portion 44 or radiating from the hub portion 44. As illustrated by the arrows in FIG. 2, with this configuration of apertures 60, the air paths through the apertures 60 in the base portion 42 of the phasing plug 40 are directed straight to the exit of the compression driver 10, free from the abrupt "turn" typical in prior designs.

In the embodiment shown in FIGS. 3A, 3B, 4 and 5, a plurality of diagonal slots are utilized as apertures 60 in the phasing plug 40. The slots are positioned end-to-end, such as in a "zig-zag" or sawtooth type pattern, to generally form a circle centered at the central axis 36. Correspondingly, the outer surface 54 of the hub portion 44 may comprise a series of generally triangular faces extending from the first end 50 to the second end 52, as may the inner surface 62 of the housing 46. In the embodiment shown in FIGS. 6A, 6B, 7 and 8, a plurality of curved slots are utilized as apertures 60 in the phasing plug 40. Again, the slots are positioned end-to-end, such as in a smoothed "zig-zag" or sinusoidal type pattern, to generally form a circle centered at the central axis 36. Correspondingly, the outer surface 54 of the hub portion 44 may comprise a sinusoidal curved profile extending from the first end 50 to the second end 52, as may the inner surface 62 of the housing 46. It is understood that the apertures 60, hub portion outer surface 54 and housing inner surface 62 are not limited to the embodiments depicted herein and may include other suitable shapes and configurations. For example, the plurality of slots could be uninterrupted so as to form a continuous sawtooth or sinusoidal aperture.

With reference to FIGS. 2 and 16, a compression chamber 64 is defined in a space between the diaphragm 34 and the second side 58 of the phasing plug base portion 42. In practice, the height of the compression chamber 64 may be quite small (e.g., approximately 0.5 mm or less) such that the volume of the compression chamber 64 is also small. The actuation of the diaphragm 34 generates high sound-pressure acoustical signals within the compression chamber 64, and the signals travel as sound waves through the base portion 42 of the phasing plug 40 via the apertures 60 that provide passages from the second side 58 to the first side 56. From the apertures 60, the sound waves enter and radiate through the housing 46, through the central aperture 48, and propagate into the ambient environment. The configuration of apertures 60 described herein makes it possible to avoid high-frequency reflections from the hub portion 44 and to provide reflection-free propagation of sound waves from the compression chamber 64 to the exit of the compression driver 10. Therefore, minimum reflections for the sound waves are provided.

Figure 9A:
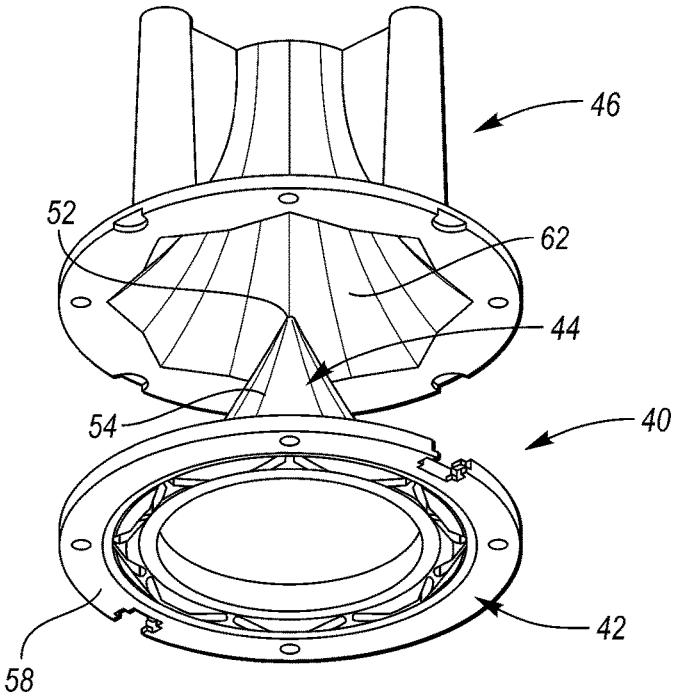
FIGS. 9A and 9B are perspective and front views, respectively, of another embodiment of phasing plug and housing, wherein a series of diagonal slots are utilized as apertures in the phasing plug, and the phasing plug and housing have a tapered profile.
Figure 9B:
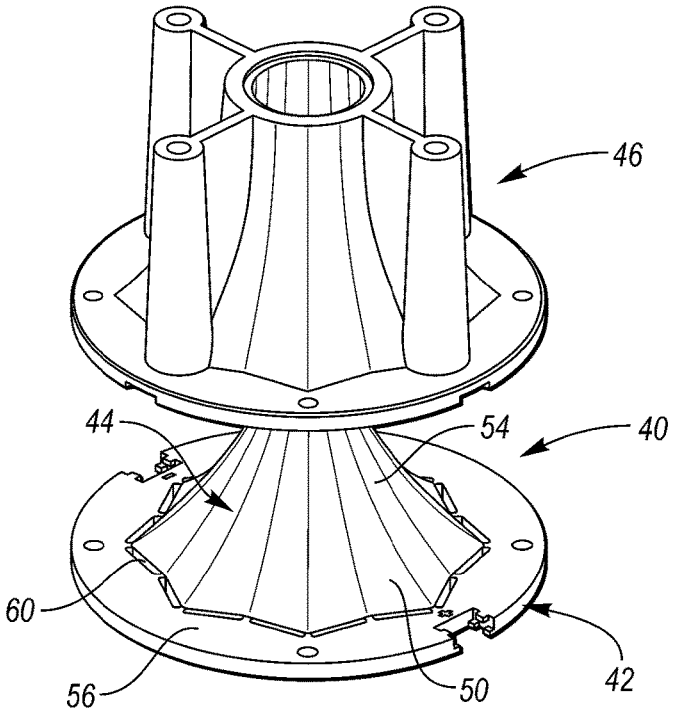
Figure 10A:
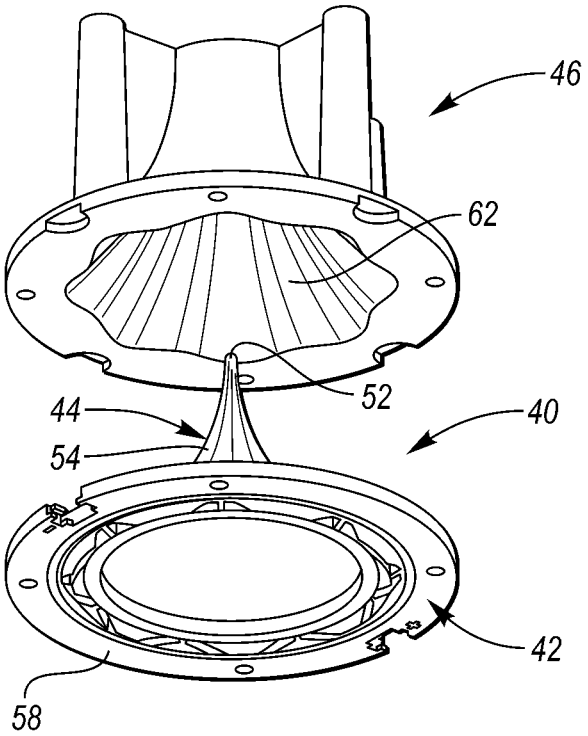
FIGS. 10A and 10B are perspective and front views, respectively, of another embodiment of phasing plug and housing, wherein a series of curved slots are utilized as apertures in the phasing plug, and the phasing plug and housing have a generally concave tapered profile.
Figure 10B:
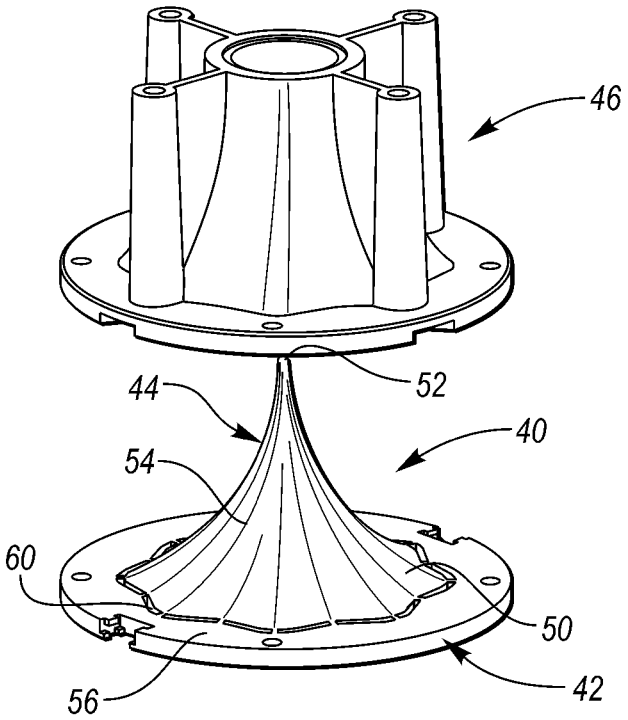
Figure 11:
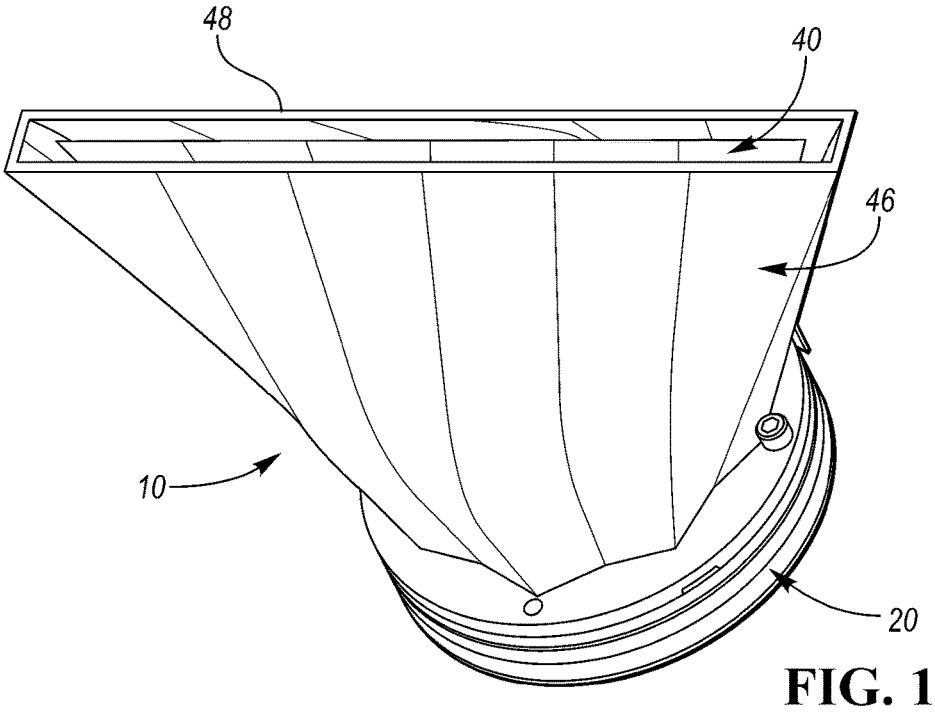
FIG. 11 is a top perspective view of a compression driver with a housing having a rectangular central aperture and wherein a series of diagonal slots are utilized as apertures in the phasing plug.

In some implementations, the outer surface 54 of the hub portion 44 may be characterized as being shaped as a "candy kiss." With reference to FIGS. 9A, 9B, 10A, 10B, 15A and 15B, the contour of the outer surface 54 of the hub portion 44 and the inner surface 62 of the housing 46 may not be straight from the first end 50 to the second end 52, but may instead be curved or concave or convex. Such a configuration of the hub portion 44 and/or housing 46 may "shape" and improve the wavefront, making it flatter at the exit of the compression driver 10. FIGS. 9A and 9B illustrate such a curved or concave contour for the embodiment where a series of diagonal slots are utilized as apertures 60, and FIGS. 10A and 10B illustrate a curved or concave contour for the embodiment where a series of curved slots are utilized as the apertures 60. Alternatively, the hub portion 44 may have a curved, convex contour (FIGS. 15A and 15B) to improve acoustical loading by providing a slower expanding exponential opening.

FIGS. 11-14 illustrate a compression driver 10 incorporating the configuration of apertures 60 and any of the other features described above with reference to the embodiments of FIGS. 1-10, but wherein the housing 46 instead has a rectangular central aperture 48. The rectangular central aperture 48 has a smaller dimension in the horizontal plane and a larger dimension in vertical plane, therefore providing wide directivity response (wider dispersion) in the horizontal plane and narrower dispersion in the vertical plane, which typically satisfies requirements for the directivity of horn drivers in practical applications. The requirement for narrow directivity in the vertical plane is especially important in line array applications where the overall array includes numerous separate systems which form a vertical wavefront close to that of a cylindrical sound wave to avoid undesirable dispersion of sound energy in the vertical plane and increase coverage distance.

Figure 12:
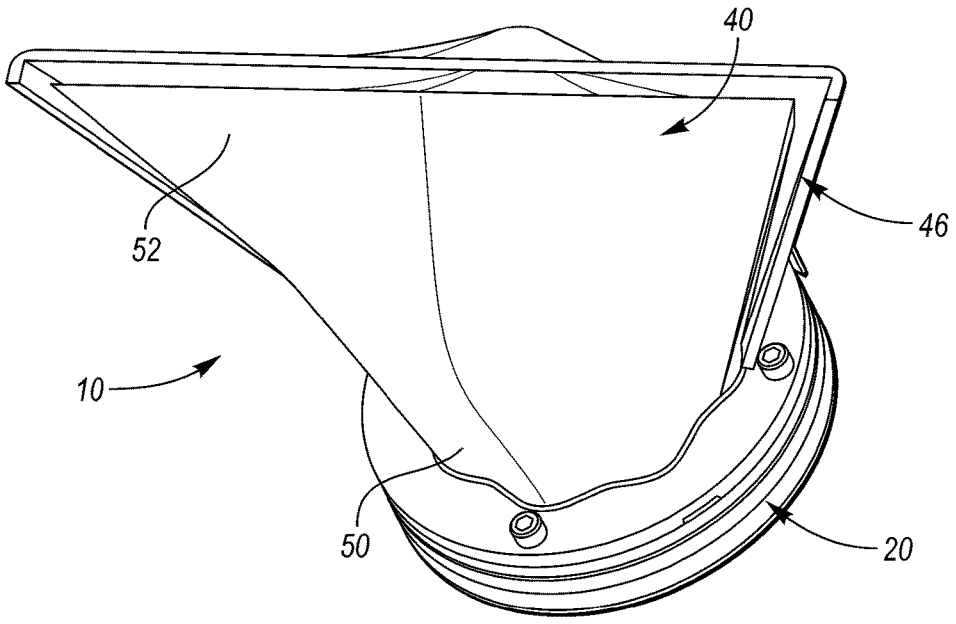
FIG. 12 is a partially cut away, top perspective view of a compression driver with a housing having a rectangular central aperture and wherein a series of curved slots are utilized as apertures in the phasing plug.
Figure 13:
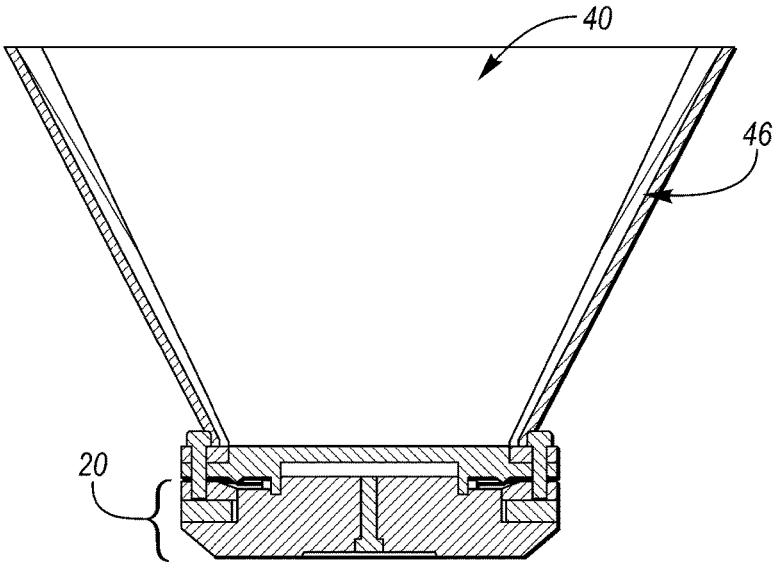
FIG. 13 depicts a longitudinal sectional view of a compression driver with an housing having a rectangular central aperture.
Figure 14:
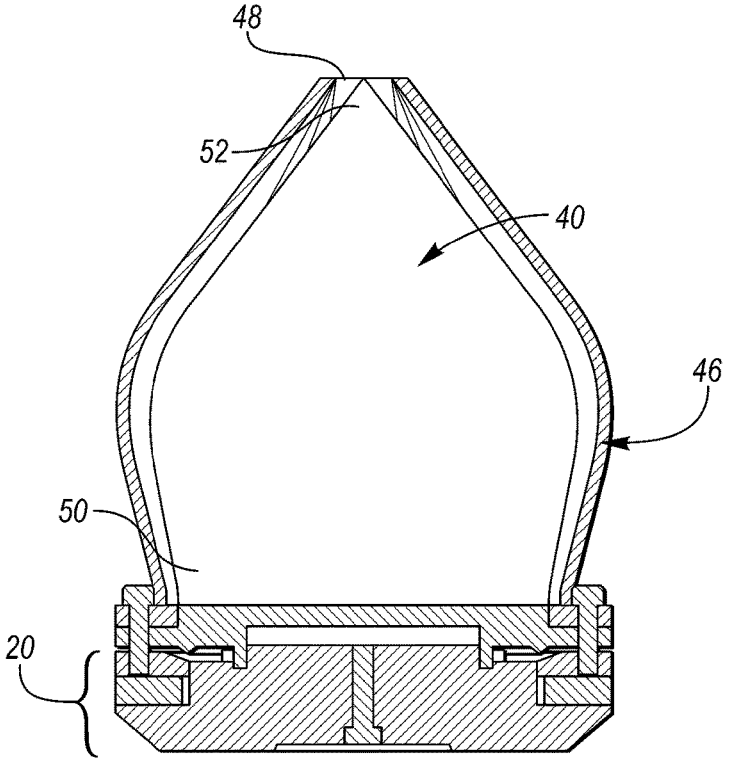
FIG. 14 is a cross-sectional view of the compression driver of FIG. 13.
Figure 15A:
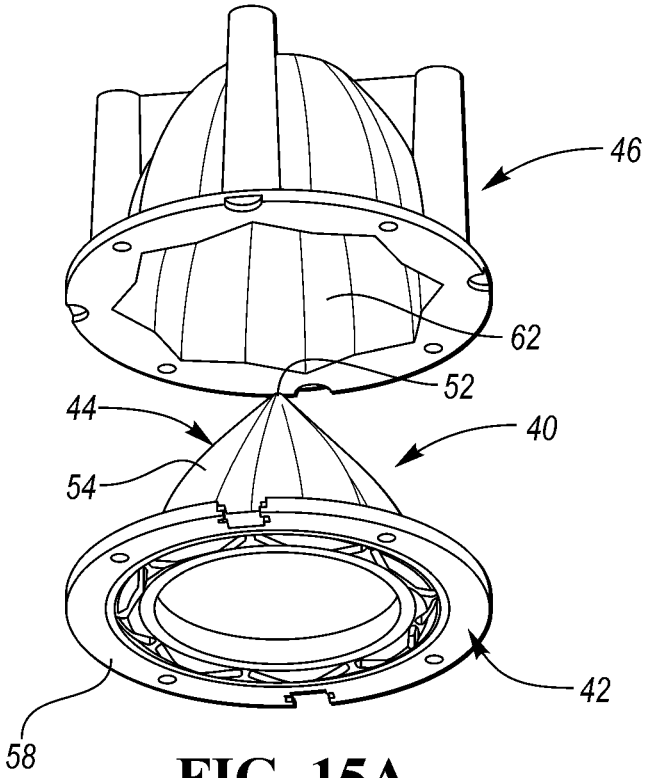
FIGS. 15A and 15B are perspective and front views, respectively, of another embodiment of phasing plug and housing, wherein a series of curved slots are utilized as apertures in the phasing plug, and the phasing plug and housing have a generally convex tapered profile.
Figure 15B:
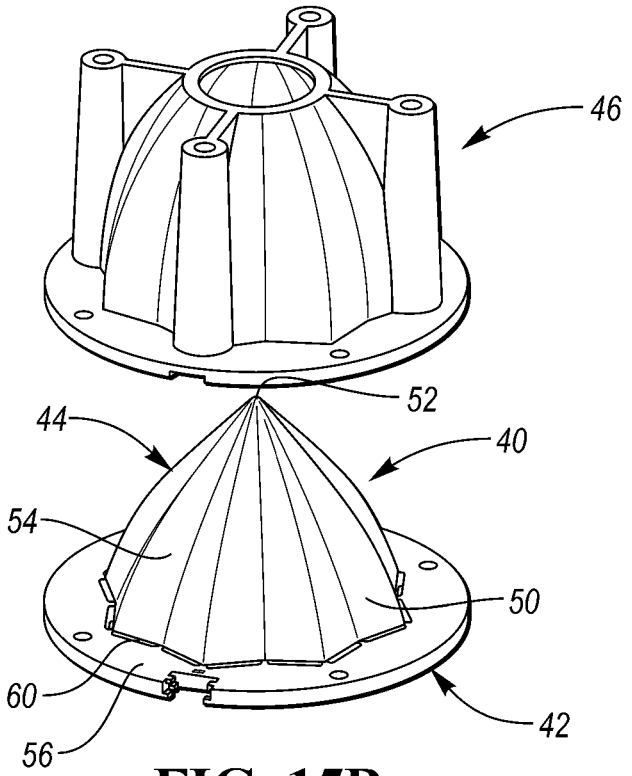

The transformation of the air path from an annular exit of the compression chamber 64 to a rectangular exit 48 of the compression driver 10 is provided by a customized shape of the hub portion 44 that starts with a generally cylindrical cross-section at the first end 50 and then transitions into a blade-like shape at the second end 52 (best shown in FIGS. 12 and 14). As with the embodiments shown above in FIGS.

1-10, the inner surface 62 of the housing 46 has a geometry or contour that may correspond to the shape of the outer surface 54 of the hub portion 44. In FIGS. 11-14, it can be seen that the cross-section of the air path expands outwards equally in vertical, horizontal, and oblique planes and then, at a certain distance from the entrance, the hub portion 44 starts narrowing linearly in horizontal plane but continues to expand linearly in the vertical plane. Finally, the hub portion 44 ends with a blade-like vertical edge and the housing 46 provides a rectangular exit 48. Although the housing 46 is depicted herein as having generally straight, conically expanding edges in the vertical plane, it is also contemplated that these edges may have a different expansion configuration.

The shape of the hub portion 44 has different profiles in the vertical and horizontal planes that provide time alignment and, correspondingly, a flat wavefront in the vertical plane at the exit of the waveguide. In modern waveguides that are typically used in line arrays, the vertical directivity is controlled by the phase and time relationships of the acoustical signals radiated at different vertical points within the waveguide's aperture. The typical goal is equal time arrival and in-phase radiation across the vertical dimension of the rectangular central aperture 48 that provides a "flat" wavefront in the vertical plane.

Advantages of the embodiments disclosed herein include, but are not limited to, a continuous gradually expanding acoustical connection of the compression chamber 64 to the exit of the compression driver 10 without reflections, averaging and randomization of acoustical output obtained from the compression chamber 64 to mitigate acoustical resonances (standing waves) in the compression chamber 64, a scalable design, a continuous and gradual acoustical connection to the exit of the compression driver 10 without "sharp turns" of the air path even in large format compression drivers, smooth and easily equalizable frequency response, and an extended frequency range.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A compression driver, comprising:

a phasing plug including a base portion having a first side and an opposed second side, and including a hub portion extending outwardly from the first side along a central axis, the hub portion including an outer surface and a first end proximate to the base portion and a second end disposed at a distance from the base portion, the base portion including a plurality of apertures that extend therethrough from the first side to the second side, the apertures arranged generally circumferentially about the central axis and oriented generally parallel to the outer surface of the hub portion, the outer surface of the hub portion having a wavelike geometry that corresponds to a configuration of the plurality of apertures;

a diaphragm disposed adjacent the phasing plug second side;

a compression chamber defined between the diaphragm and the phasing plug; and a housing positioned on the phasing plug first side, the housing having a central aperture generally aligned with the hub portion and forming an exit of the compression driver, the housing having an inner surface which forms a waveguide with the outer surface of the hub portion.

2. The compression driver of claim 1, wherein the plurality of apertures includes a plurality of diagonal slots positioned end-to-end in a sawtooth pattern, and the outer surface of the hub portion includes a series of generally triangular faces extending from the first end to the second end.

3. The compression driver of claim 1, wherein the plurality of apertures includes a plurality of curved slots positioned end-to-end in a sinusoidal pattern, and the outer surface of the hub portion includes a sinusoidal curved profile extending from the first end to the second end.

4. The compression driver of claim 1, wherein the central aperture is circular.

5. The compression driver of claim 1, wherein the central aperture is rectangular.

6. The compression driver of claim 1, wherein the inner surface of the housing has a geometry that corresponds to a geometry of the outer surface of the hub portion.

7. The compression driver of claim 1, wherein the outer surface of the hub portion tapers from the first end to the second end.

8. The compression driver of claim 7, wherein a contour of the outer surface of the hub portion is one of generally concave or generally convex from the first end to the second end.

9. The compression driver of claim 1, wherein the diaphragm is configured as an annular ring.

10. The compression driver of claim 1, further comprising a magnet assembly disposed beneath the diaphragm, the magnet assembly including an annular permanent magnet disposed between an annular top plate and a back plate having a centrally disposed pole piece, the magnet assembly providing a magnetic field in a magnetic gap located between the pole piece and an inside surface of the top plate.

11. The compression driver of claim 10, further comprising a voice coil disposed in the magnetic gap and coupled to the diaphragm for producing movement of the diaphragm.

12. A phasing plug assembly for a compression driver, comprising:

a phasing plug including a base portion having a first side and an opposed second side, and including a hub portion extending outwardly from the first side along a central axis, the hub portion including an outer surface and a first end proximate to the base portion and a second end disposed at a distance from the base portion, the base portion including a plurality of apertures that extend therethrough from the first side to the second side, the outer surface of the hub portion including one of a series of triangular faces extending from the first end to the second end or a sinusoidal curved profile extending from the first end to the second end, wherein a geometry of the outer surface of the hub portion corresponds to a configuration of the plurality of apertures, the apertures including a series of slots positioned end-to-end generally circumferentially about the central axis and oriented generally parallel to the outer surface of the hub portion; and a housing positioned on the phasing plug first side, the housing having a central aperture generally aligned with the hub portion and forming an exit of the compression driver, the housing having an inner surface which forms a waveguide with the outer surface of the hub portion.

13. The phasing plug assembly of claim 12, wherein the plurality of apertures includes a plurality of diagonal slots in a sawtooth pattern.

14. The phasing plug assembly of claim 12, wherein the plurality of apertures includes a plurality of curved slots in a sinusoidal pattern.

15. The phasing plug assembly of claim 12, wherein the inner surface of the housing has a geometry that corresponds to a geometry of the outer surface of the hub portion.

16. A phasing plug assembly for a compression driver, comprising:

a phasing plug including a base portion having a first side and an opposed second side, and including a hub portion extending outwardly from the first side along a central axis, the hub portion including an outer surface and a first end proximate to the base portion and a second end disposed at a distance from the base portion, wherein the outer surface of the hub portion has a generally cylindrical cross-section at a first end proximate the base portion and transitions into a blade shape at a second end disposed at a distance from the base portion, the base portion including a plurality of apertures that extend therethrough from the first side to the second side, the apertures arranged generally circumferentially about the central axis and oriented generally parallel to the outer surface of the hub portion, the outer surface of the hub portion having a wavelike geometry that corresponds to a configuration of the plurality of apertures; and a housing positioned on the phasing plug first side, the housing having a rectangular central aperture generally aligned with the hub portion and forming an exit of the compression driver, the housing having an inner surface which forms a waveguide with the outer surface of the hub portion.

17. The phasing plug assembly of claim 16, wherein the plurality of apertures includes a plurality of diagonal slots positioned end-to-end in a sawtooth pattern, and the outer surface of the hub portion includes a series of generally triangular faces extending from the first end to the second end.

18. The phasing plug assembly of claim 16, wherein the plurality of apertures includes a plurality of curved slots positioned end-to-end in a sinusoidal pattern, and the outer surface of the hub portion includes a sinusoidal curved profile extending from the first end to the second end.

* * * * *